US006685183B2

(12) United States Patent
Kim

(10) Patent No.: US 6,685,183 B2
(45) Date of Patent: Feb. 3, 2004

(54) AUTOMATIC TELLER MACHINE

(75) Inventor: Dong-gyun Kim, Seoul (KR)

(73) Assignee: FL Technology Inc., Seoul (KR)

( * ) Notice: Subject to any disclaimer, the term of this patent is extended or adjusted under 35 U.S.C. 154(b) by 62 days.

(21) Appl. No.: 10/121,185

(22) Filed: Apr. 12, 2002

(65) Prior Publication Data

US 2002/0195489 A1 Dec. 26, 2002

(30) Foreign Application Priority Data

Apr. 12, 2001 (KR) ..... 2001-19563

(51) Int. Cl.[7] ..... B65H 3/06
(52) U.S. Cl. ..... 271/114; 902/15
(58) Field of Search ..... 271/109, 114; 221/259; 400/629; 380/24; 705/43; 902/15; B65H 3/06

(56) References Cited

U.S. PATENT DOCUMENTS 4,843,903 A * 7/1989 Tanaka et al. ..... 74/354
5,793,399 A * 8/1998 Kawakami et al. ..... 347/104
6,547,236 B1 * 4/2003 Yip et al. ..... 271/115

* cited by examiner

*Primary Examiner*—Donald P. Walsh
*Assistant Examiner*—Kenneth W. Bower

(57) ABSTRACT

Disclosed is an automatic teller machine (ATM) including a clutch device for selectively supplying power to a pick-up roller for extracting banknotes from a banknote storage cassette located within the ATM. The clutch device includes a driving gear rotatably mounted to the frame for receiving the rotational driving force from the drive motor to rotate the plurality of driving rollers, an idle gear engaged with the driving gear for rotating in response the rotational movement of the driving gear, a pick-up roller gear fixedly mounted on a rotating shaft of the pick-up roller and engaged with the idle gear for rotating the pick-up roller and, and a motor control means adapted to allow the idle gear to be engaged with or disengaged from the pick-up roller. Therefore, since the transmission of a rotational driving force to the pick-up roller is performed by means of gears, not friction plates, the control performance of power transmission of the clutch device is uniformly maintained even after use for extended period of time. Also, the pick-up roller can rapidly respond to the power transmission of the clutch device by employing an actuator for allowing the gears to be selectively engaged with or disengaged from each other. Further, extra rotation of the pick-up roller due to rotational inertia thereof is prevented by employing stopping means for exclusively controlling the overall operation of the pick-up roller, thus allowing the pick-up roller to perform the correct extraction of banknotes.

16 Claims, 6 Drawing Sheets

AUTOMATIC TELLER MACHINE

BACKGROUND OF THE INVENTION

1. Field of the Invention

The present invention relates to an automatic teller machine, and more particularly, to an automatic teller machine (hereinafter, referred to as "ATM") including a clutch device for selectively supplying power to a pick-up roller for extracting banknotes from a banknote storage cassette located within the ATM 2. Description of the Related Art ATMs are convenient automated banking machines in widespread use which allow a user to easily withdraw or deposit money from or into his or her account anytime. An ATM is constructed such that a banknote storage cassette containing banknotes is installed at a certain location within the machine and a plurality of sets of driving rollers and driven rollers are driven to discharge banknotes stacked within the storage cassette to the outside FIG. 1 is a schematic longitudinal sectional view illustrating a banknote discharging mechanism of a typical ATM. As shown in FIG. 1, the ATM includes a banknote storage cassette 12 detachably mounted to a frame 10 defining an internal space for stacking banknotes therein, a pick-up roller 14 for extracting individual banknotes from the banknote storage cassette located within the ATM, a plurality of sets of driving and driven rollers 18 and 16 for feeding banknotes extracted from the pick-up roller 14 to be discharged to the outside The banknote storage cassette 12 is detachably mounted to the frame 10 and is managed such that it is always filled with banknotes. Also, the banknote storage cassette 12 is provided with a banknote extracting port for allowing a banknote to escape therefrom, and a pick-up roller 14 is disposed in front of the banknote extracting port. The pick-up roller 14, which forms a pair of rollers together with a driven roller 16, serves to extract banknotes one by one from the banknote storage cassette 12 and begin to feed the extracted banknotes.

The banknotes extracted by the pick-up roller 14 from the banknote storage cassette 12 are fed through a plurality of sets of driving and driven rollers 18 and 16 and are discharged one by one to the outside. A rotational driving force from a separate drive motor (not shown) is transmitted through a power transmission means such as gears, a belt or the like to a driving shaft for rotating each of the driving rollers 18.

In the meantime, the drive motor (not shown) rotates each of the driving rollers 18 and the pick-up rollers 16. At this time, a clutch device (not shown) is provided between the drive motor and the pick-up roller 14. The clutch device interrupts or permits transmission of a rotational driving force to the pick-up roller 14 from the drive motor so that a desired number of banknotes can be discharged to the outside. Accordingly, the pick-up roller 14 rotates only during the extraction of banknotes and waits in a stationary state where banknotes are not being extracted.

For example, in the case where five banknotes are withdrawn, the pick-up roller 14 extracts them from the banknote storage cassette 12 and then must stop its extracting operation. At this time, each of the driving rollers 18 continuously operates irrespective of the stopping of the extracting operation of the pick-up roller 14 and rotates until the fifth banknote extracted from the banknote storage cassette 12 is completely discharged to the outside of the ATM.

Accordingly, the rotational driving force transmitted to the pick-up roller 14 and the driving rollers 18 from the drive motor must be continuously transmitted to the driving rollers 18 during the discharge of the extracted banknotes, but must not be transmitted to the pick-up roller 14 immediately after the last one of the extracted banknotes is discharged to the outside. For the purpose of carefully controlling the rotational operation of the pick-up roller, a clutch device is installed between the drive motor (not shown) and the pick-up roller 14.

However, for a conventional clutch device employing a pair of oppositely faced friction plates, there has been a problem that if the friction plates are worn, performance and reliability of the clutch device are degraded. In addition, if the operation of the clutch device is interrupted in order to stop the pick-up roller 14 after discharge of the last banknote, the pick-up roller 14 is not stopped immediately by virtue of rotational inertia so that an extra banknote may be further extracted to some extent from the banknote storage cassette and then its extraction may be stopped. As a result, in the case where the next user withdraws banknotes from the ATM, the machine may malfunction and there may be a banknote jam due to the extraction of two or more overlapped banknotes between the pick-up roller and the driven roller, or the withdrawing operation may not be performed cleanly.

SUMMARY OF THE INVENTION

To solve the above-described problems, it is a primary object of the present invention to provide an automatic teller machine (ATM) including a clutch device in which the control performance of power transmission of the clutch device is no longer degraded even after use for an extended period of time by using gears, rather than friction plates in transmitting rotational driving force to a pickup roller, in which the pick-up roller can rapidly respond to the power transmission by the clutch device by employing an actuator for selectivity engaging or disengaging the gears, and which can prevent undesired extra rotation of a pick-up roller due to ordinary rotational inertia thereof by means of a stopping means for stopping the pick-up roller, to allow the pick-up roller to perform the correct extraction of banknotes.

In order to accomplish the primary object, according to an aspect of the present invention, there is provided an automatic teller machine (ATM) having a frame for defining an internal space, a banknote storage cassette installed within the frame for containing a plurality of banknotes, a pick-up roller for extracting the plurality of banknotes one by one, a plurality of driving rollers for feeding the banknotes extracted from the banknote storage cassette together with a plurality of driven rollers along a predetermined banknote traveling path to discharge them, the plurality of driving rollers each being rotated by means of a rotational driving force transmitted thereto from a drive motor, and a clutch device for selectively transmitting the rotational driving force generated from the drive motor to the pick-up roller, the clutch device including a driving gear rotatably mounted to the frame for receiving the rotational driving force from the drive motor to rotate the plurality of driving rollers, an idle gear engaged with the driving gear, a pick-up roller gear fixedly mounted on a rotating shaft of the pick-up roller and capable of being engaged with the idle gear for rotating the pick-up roller and, and a motor control means adapted to allow the idle gear to be engaged with or disengaged from the pick-up roller.

The motor control means may include an actuator laterally and fixedly mounted to the frame and having an actuator rod which operate in response to the external application of electric power thereto, and a support plate rotatably mounted to the frame such that a rotating shaft of the driving gear penetrates the support plate, the support plate supporting the idle gear and the driving gear such that they are engaged with each other and rotate about the rotating shaft of the driving gear in response to a longitudinal movement of the actuator rod so that the idle gear is engaged with or disengaged from the pick-up roller gear.

Also, the actuator and the support plate are coupled to each other by means of a link member such that the link member is coupled at one end to the actuator rod and at the other end to the upper end portion of the support plate with the other end of the link member having an extended slot formed therein, and a holding projection is formed at the upper end portion of the support plate so that it fits into the slot of the link member.

Preferably, the support plate includes a first elastic means for providing rotation momentum in a direction in which the idle gear is moved toward the pick-up roller, and a second elastic means for providing rotation momentum in a reverse direction to the direction of the first elastic means.

Further, the first elastic means is preferably a first tension coil spring disposed in parallel with the link member such that the first tension coil spring is coupled at one end to the actuator rod and at the other end to the support plate so as to provide a tensile force, and the second elastic means is preferably a second tension coil spring fixedly coupled at one end to the lower end of the frame and at the other end to the frame so as to provide a tensile force.

The support plate may include a stopping means for stopping the pick-up roller gear at the moment when the idle gear is moved away from the pick-up roller gear in response to the rotation of the support plate.

Also, the stopping means may include a latch gear fixedly mounted on the rotating shaft of the pick-up roller and having a plurality of V-shaped grooves, and a stopper fastened to the support plate, the stopper being moved into engagement with one of the plurality of V-shaped grooves to stop the pick-up roller gear at the moment when the idle gear is moved away from the pick-up roller gear in response to the rotation of the support plate.

The support plate is preferably composed of a rotatable support plate positioned between the frame and the driving gear, and a cover plate having the same shape as the rotatable support plate and rotatably mounted on the rotating shaft of the driving gear in parallel with the rotatable support plate such that the driving gear and the idle gear are engaged with each other between the rotatable support plate and the cover plate.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Hereinafter, the present invention will be in detail described with reference to the accompanying drawings.

Figure 2:
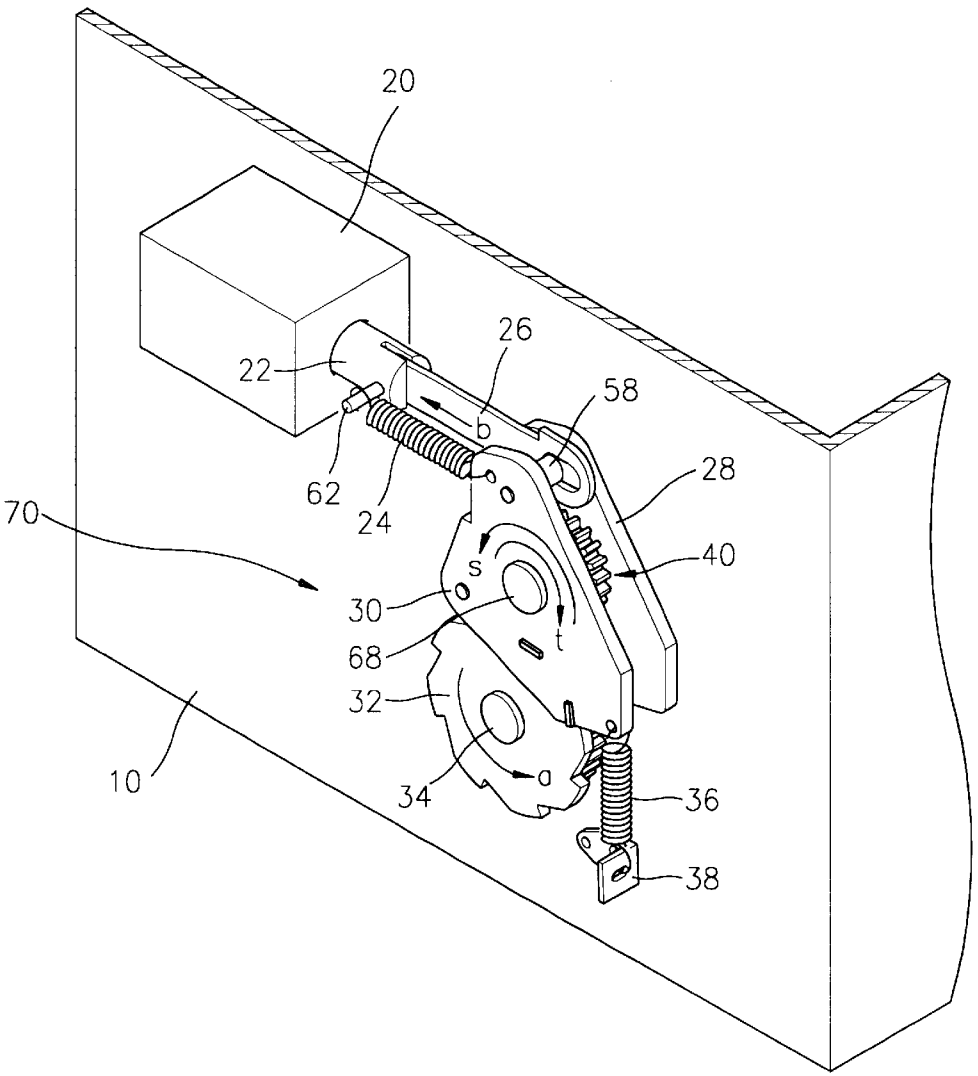
FIG. 2 is a fragmentary perspective view illustrating the construction of a clutch device according to an embodiment of the present invention.

FIG. 2 is a fragmentary perspective view illustrating the construction of a clutch device according to an embodiment of the present invention. As shown in FIG. 2, there is shown the clutch device 70 of the ATM including an actuator 20, a rotatable support plate 28 and a cover plate 30, and a latch gear 32.

The actuator 20 is laterally mounted to the outer side wall of a frame 10. The rotatable support plate 28 and the cover plate 30 are coupled to the actuator 20 and rotate about a rotating shaft 68. The latch gear 32 is positioned at the lower portion of the rotatable support plate 28 and the cover plate 30. Also, a driving gear 40, an idle gear 42 (see FIG. 4) and a stopper 46 (see FIG. 3) are disposed between the rotatable support plate 28 and the cover plate 30. The rotational center axis of the latch gear 32 is the rotating shaft of a pick-up roller (not shown) within the frame 10

The clutch device 70 is basically constructed such that the actuator 20 is driven to transmit a rotational driving force generated by a drive motor (not shown) to a pick-up roller shaft 34 or to interrupt the transmission of the rotational driving force thereto. Accordingly, the clutch device 70 serves to stop the pick-up roller shaft 34 immediately after a desired number of banknotes are completely extracted from a banknote storage cassette.

The actuator 20 is laterally and fixedly mounted to the frame 10 so that an actuator rod 22 thereof reciprocates in the horizontal direction. The actuator 20, which is supplied with electric power externally for its own operation, includes a well-known solenoid installed therein and is driven by means of an electromagnetic force generated from the solenoid.

The rotatable support plate 28 and the cover plate 30 rotate about the rotating shaft 68, have the same shape, are disposed in parallel with each other, and their upper end portions are coupled to the actuator 20. Also, the rotatable support plate 28 and the cover plate 30 are coupled to each other by means of a holding projection 58 (see FIG. 3) and an idle gear supporting shaft 48 (see FIG. 3). The idle gear 42 (see FIG. 3) is rotatably mounted on the idle gear supporting shaft 48.

The rotating shaft 68 receives a rotational driving force from the drive motor (not shown) for rotation, and the driving gear 40 is fixedly mounted on the rotating shaft 68 which penetrates the rotatable support plate 28 and the cover plate 30. That is, the rotating shaft 68 is fastened to the driving gear 40 but is not fastened to the rotatable support plate 28 and the cover plate 30, so that when the rotating shaft 68 rotates, only the driving gear 40 rotates between the rotatable support plate 28 and the cover plate 30.

The upper portions of the rotatable support plate 28 and the cover plate 30 are coupled to each other by means of the holding projection 58. Also, the holding projection 58 and the actuator rod 22 are coupled to each other by means of a link member 26. Accordingly, when electric power is applied to the actuator 20 so that the actuator rod 22 is moved in the longitudinal direction, the support plate 28 and the cover plate 30 rotate about the rotating shaft 68 of the driving gear 40.

Further, The upper portions of the support plate 28 and the cover plate 30 are coupled to a first tension coil spring 24 which is coupled to at one end to the actuator rod 22. The first tension coil spring 24 is disposed in parallel with the link member 26, and when the actuator rod 22 is moved in the direction of arrow "b" the first tension coil spring 24 pulls the cover plate 30 to rotate it in the direction of arrow "s".

In the meantime, the idle gear 42 (see FIG. 3) is rotatably mounted on the fixed shaft 64 between the rotatable support plate 28 and the cover plate 30. The idle gear 42 is engaged with the driving gear 40 so that it rotates during the rotation of the driving gear 40. Also, when the rotatable support plate 28 and the cover plate 30 rotate in the direction of arrow "s" or "t", the idle gear 42, being engaged with the driving gear 40, rotates about the rotating shaft 68 like a planetary gear.

A second tension coil spring 36 is provided at the lower end portion of the cover plate 30. The lower end of the second tension coil spring 36 is fixed to a fixed hook 38 and the upper end thereof is fixed to the cover plate 30. The second tension coil spring 36 imparts torque to the cover plate 30 so that the rotatable support plate 28 and the cover plate 30 rotate in the direction of arrow "t", i.e., in the clockwise direction.

Consequently, when the actuator rod 22 is moved in the direction of arrow "b", the first tension coil spring 24 pulls the upper end portion of the cover plate 30 so that torque acts on the cover plate 30 in the direction of arrow "s", i.e., in the counter-clockwise direction. At this time, the second tension coil spring 36 is maintained in an extended state. On the contrary, when the actuator rod 22 is moved in the direction opposite to the direction of arrow "b", the second tension coil spring 24 is returned to an original state to rotate the cover plate 30 in the direction of arrow "t".

The fixed hook 38 is a typical supporting member fastened to the frame 10 to support the lower end of the second tension coil spring 24.

Figure 1:
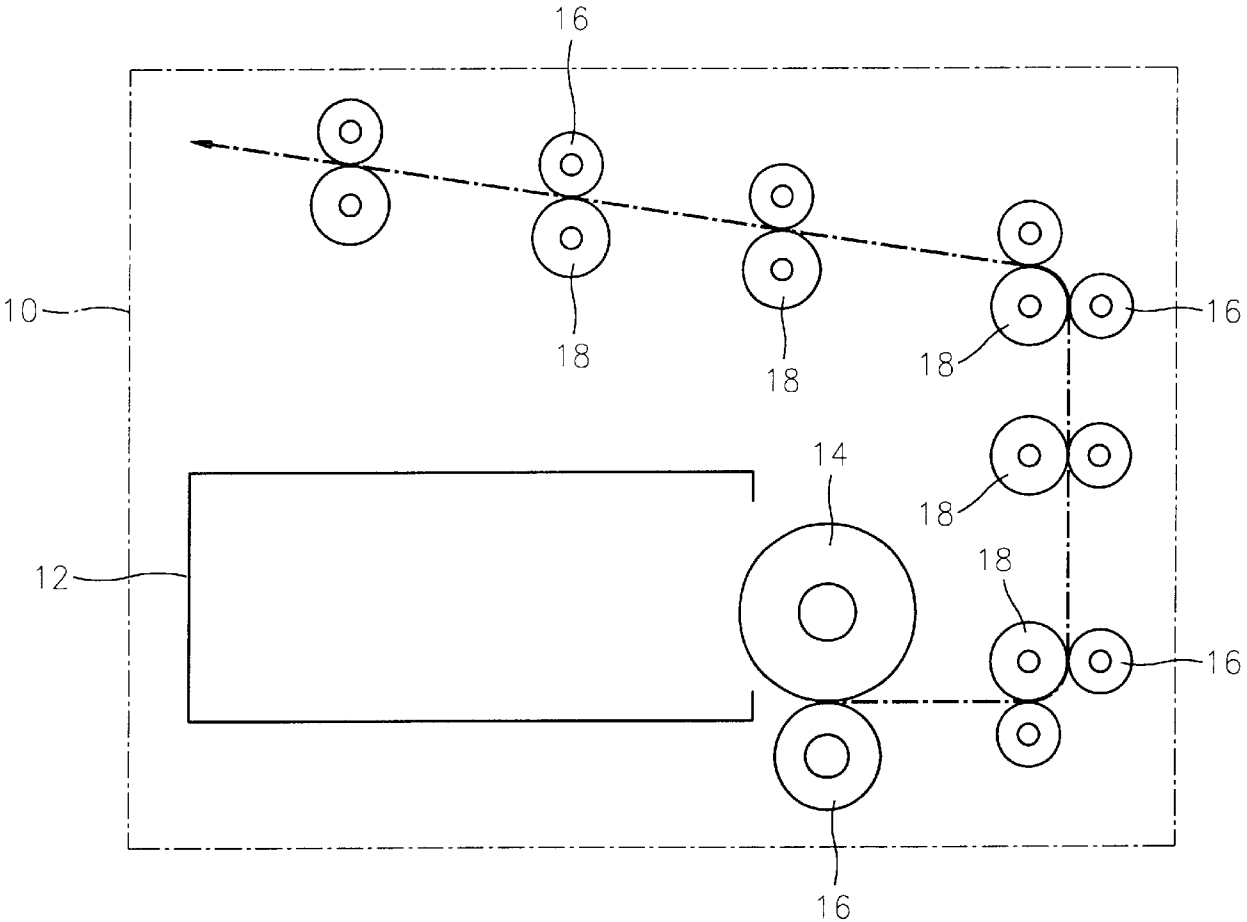
FIG. 1 (PRIOR ART)
FIG. 1 is a schematic longitudinal sectional view illustrating a banknote withdrawing mechanism of a conventional ATM.

A latch gear 32 and a pick-up roller gear 44 (see FIG. 3) are provided just under the driving gear 40 and the idle gear 42. The latch gear 32 and the pick-up roller gear 44 are both fixedly mounted on the pick-up roller shaft 34 such that they have the same rotational center axis. The pick-up roller shaft 34 is extended to the pick-up roller 14 (see FIG. 1) included within the frame 10, and as shown in FIG. 1, laterally protrudes from the outer side wall surface of the frame 10 so that it is fixedly coupled to the latch gear 32 and the pick-up roller gear 44.

The latch gear 32 and the pick-up roller gear 44 may be constructed such that they are integral with each other or are spaced apart from each other.

As will be described later, the pick-up roller gear 44 is selectively engaged with the idle gear 42 in response to the rotation of the cover plate 30 in the direction of arrow "s".

The latch gear 32 is a type of disc having a series of alternating gear teeth and V-shaped grooves 66. The latch gear 32 can rotate in only one direction, namely, the clockwise direction, similar to a typical latch gear, and does not rotate in the reverse direction, namely, the counterclockwise direction, due to being latched by the stopper 46. The latch gear 32 is intercepted and stopped by the stopper 46 (see FIG. 3) so that the rotation of the pick-up roller 14 is interrupted.

Accordingly, when the stopper 46 is received in a V-shaped groove 66 formed on the outer surface of the latch gear 32, the latch gear 32 no longer rotates in the direction of arrow "a". Thus, when the cover plate 30 rotates in the direction of arrow "t" in FIG. 2 so that the stopper 46 is received in the V-shaped groove 66 of the latch gear 32, the rotation of the latch gear is interrupted immediately which, in turn, stops the rotation of the pick-up roller shaft 34.

Figure 3:
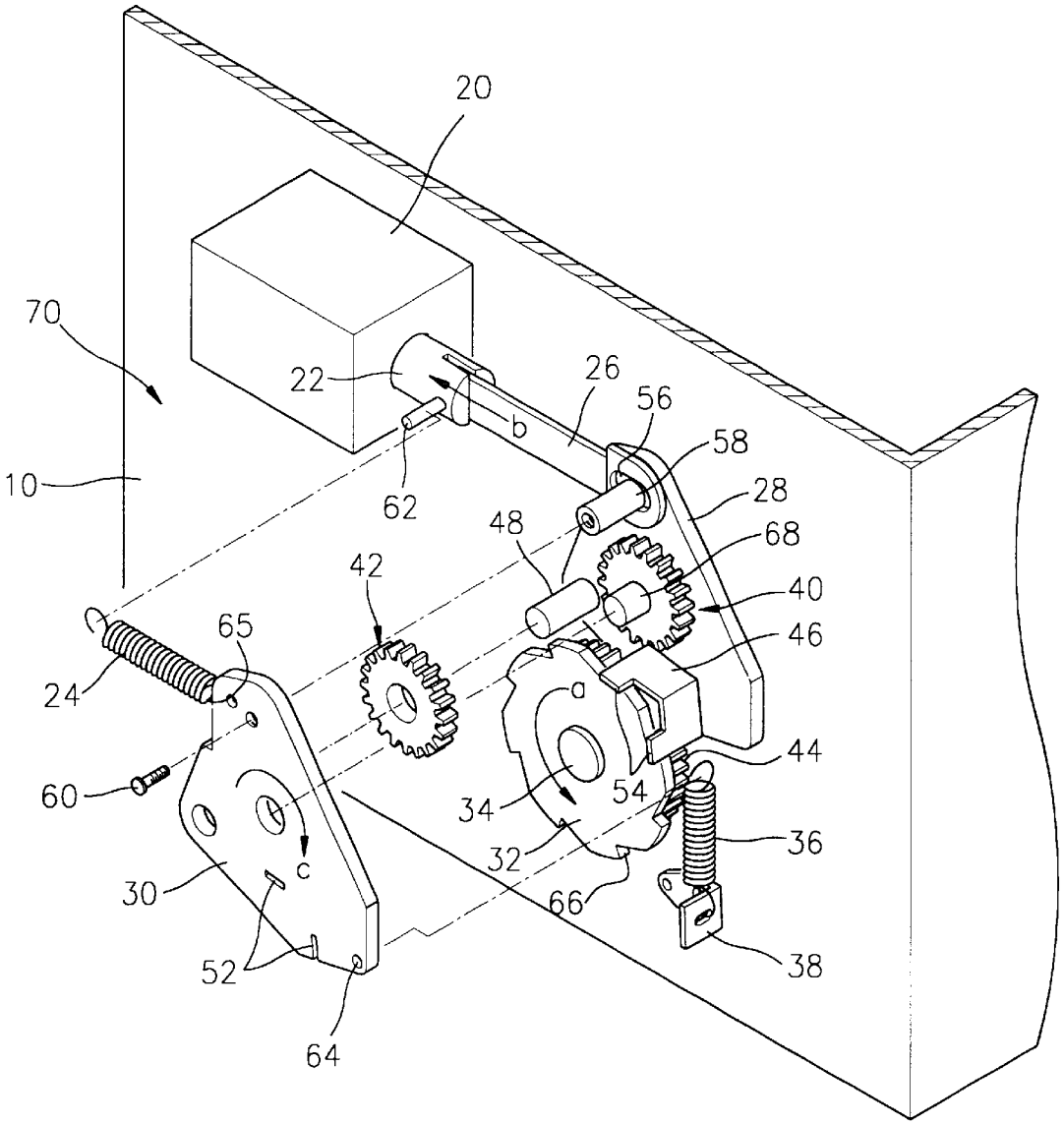
FIG. 3 is a fragmentary, exploded perspective view illustrating the construction of the clutch device of FIG. 2.

FIG. 3 is a fragmentary, exploded perspective view illustrating the construction of the clutch device 70 of FIG. 2.

Referring to FIG. 3, each of the rotatable support plate 28 and the cover plate 30 is penetrated by the rotating shaft 68. A well-known bearing (not shown) may be provided between the outer surface of the rotating shaft 68 and the inner surface of the hole of each plate to more smoothly rotate the rotating shaft 68 with respect to each of the plates 28 and 30.

A holding projection 58, an idle gear supporting shaft 48 and a stopper 46 are fastened on the outer surface of the rotatable support plate 28. The holding projection 58 having a cylindrical shape is provided with a threaded opening into which a corresponding screw 60 is inserted At this time, the screw 60 is engaged with the threaded opening 60. That is, the screw 60 is screwed into a hole formed in the cover plate 30 to engage with the holding projection 58 so that the cover plate 30 is fixedly coupled to the rotatable support plate 28.

Also, the idle gear supporting shaft 48 of a cylindrical shape serves to rotatably support the idle gear 42 and to maintain the spacing between the rotatable support plate 28 and the cover plate 30. At this time, a well-known bearing (not shown) may be provided between the idle gear supporting shaft 48 and the idle gear 42 to more smoothly rotate the idle gear 42 with respect with the idle gear supporting shaft 48.

The stopper 46 is positioned between the driving gear 40 and the latch gear 32 and is fastened to the inner side surface of the rotatable support plate 28. The stopper 46 is formed of an iron piece of the type downwardly bent, and when the cover plate 30 rotates in the direction of arrow "c" by means of a tensile force of the second tension coil spring 36 the stopper 46 is latched by one of the V-shaped grooves 66 on the latch gear 32.

Similar to the holding projection 58 and the idle gear supporting shaft 48 of the idle gear 42, the stopper 46 also acts to maintain the spacing between the rotatable plate 28 and the cover plate 30. For this purpose, the stopper 46 is provided with two fitting protrusions 54 formed at both free ends thereof, and the cover plate 30 is provided with stopper fitting slots 52 into which the fitting protrusions 54 are inserted in a such a fashion that each of the stopper fitting slots 52 receives one of the fitting protrusions Accordingly, the spacing between the rotatable plate 28 and the cover plate 30 is maintained uniform by means of the holding projection 48, the idle gear supporting shaft 48 and the stopper 46 so that a parallel relationship is maintained between the rotatable plate 28 and the cover plate 30, and the driving gear 40 and the idle gear 42 are engaged with each other and rotate together.

In the meantime, the link member 26, one end of which is coupled to the actuator rod 22 of the actuator 20, is formed of a rod that extends longitudinally and horizontally, and is provided with an extended slot 56 formed at the other end thereof. The extended slot 56 is formed as an elliptical hole that extends in the longitudinal direction of the link member 26 so that the holding projection 58 fits into the extended slot 56.

Moreover, a fixed hook 62 laterally protrudes from one side wall of the actuator rod 22 such that one end of the first tension coil spring 24 is fixedly mounted on the fixed hook 62. Also, an upper spring coupling hole 65 is formed at the upper end portion of the cover plate 30 so that the first tension coil spring 24 is fixedly coupled at the other end thereof to the upper spring coupling hole 65. That is, the first tension coil spring 24 is fixedly coupled to the fixed hook 62 of the actuator rod 22 and the upper spring coupling hole 65 such that it is positioned in parallel with the link member 26.

When the actuator rod 22 is pulled in the direction of arrow "b" to be moved toward the inside of the actuator 20, the first tension coil spring 24 pulls the upper end portion of the cover plate 30 so that the idle gear 42 is moved into engagement with the pick-up roller gear 44.

In addition, a lower spring coupling hole 64 is formed at the lower end portion of the cover plate 30 so that the second tension coil spring 36 is fixedly coupled at the one end thereof to the lower spring coupling hole 64 and at the other end thereof to the fixed hook 38 that is fastened to the frame 10. The fixed hook 38 is positioned below the lower spring coupling hole 64. The second tension coil spring 36 provides a tensile force to rotate the cover plate 30 in the direction of arrow "c" such that it is extended when the actuator rod 22 is moved in the direction of arrow "b", whereas it is retracted and returned to an original state when the actuator rod 22 is moved in the reverse direction relative to the arrow "b" direction to provide torque to rotate the cover plate 30 in the direction of arrow "c".

Figure 4:
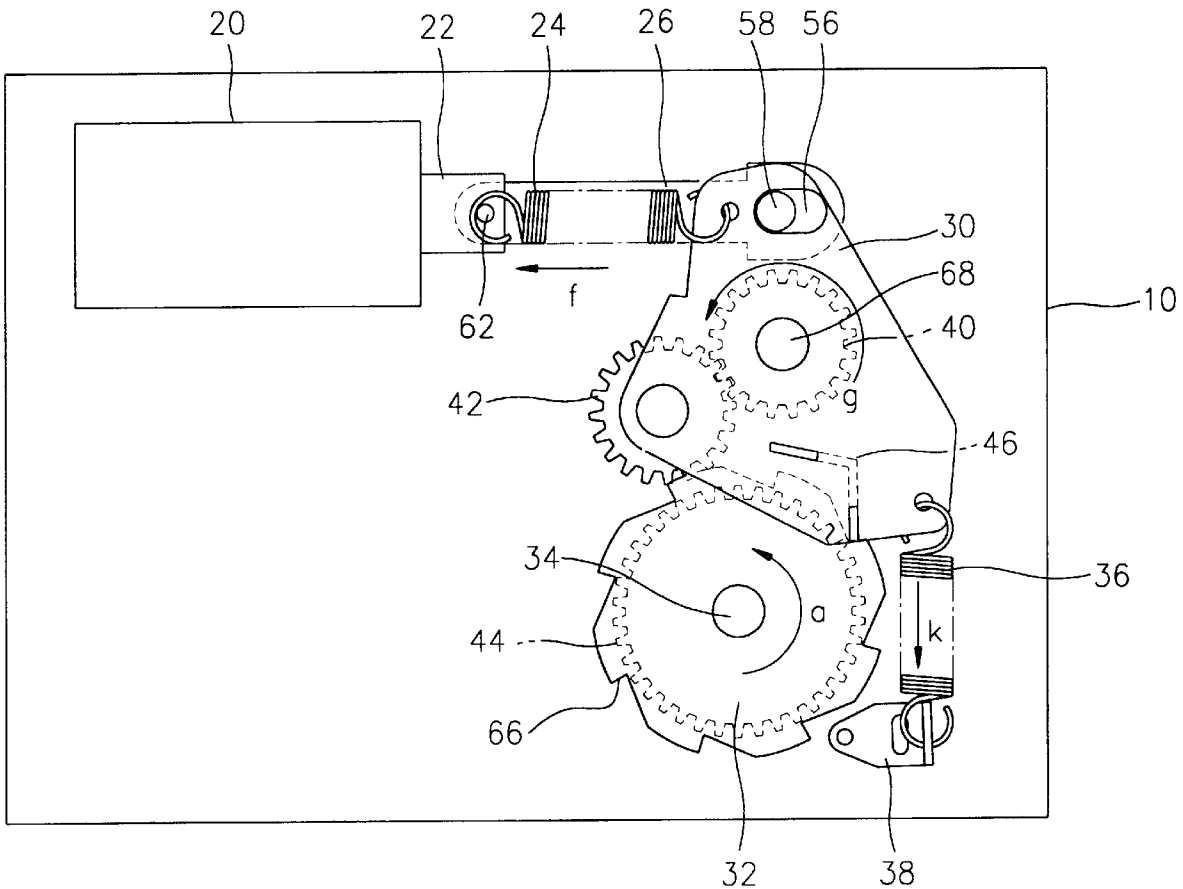
FIGS. 4 through 6 are schematic cross-sectional views illustrating the operation of the clutch device within an ATM according to an embodiment of the present invention.
Figure 5:
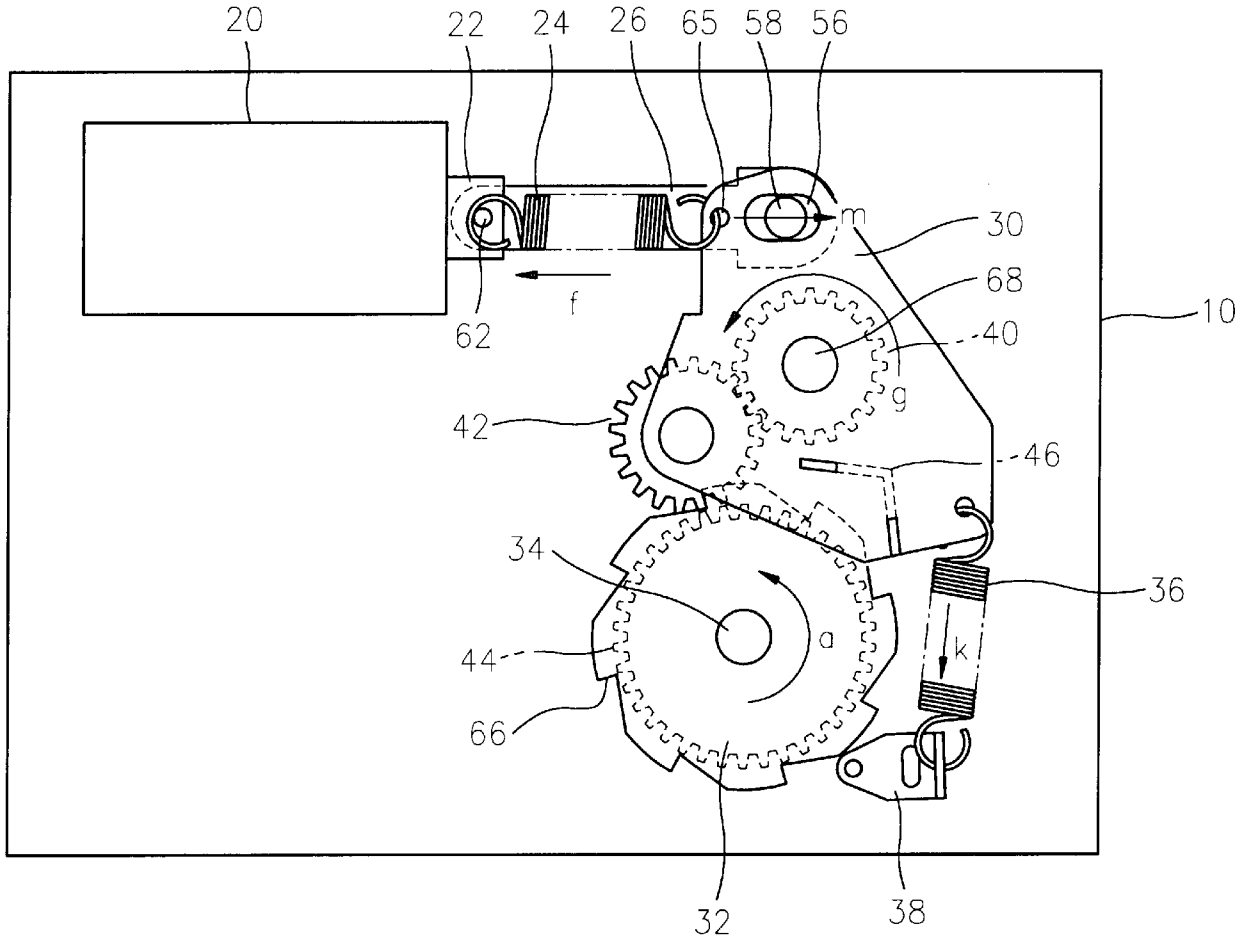
Figure 6:
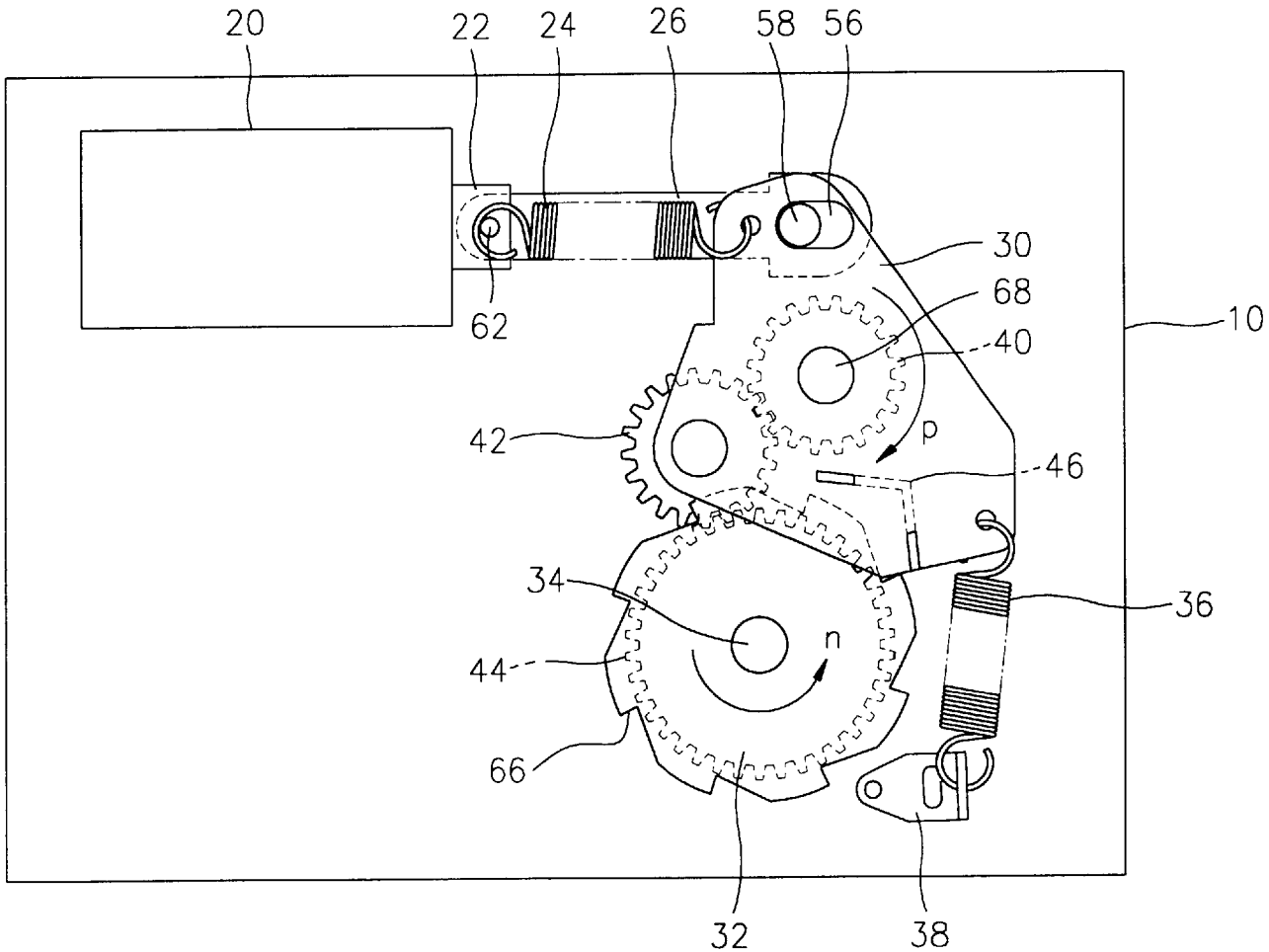

FIGS. 4 through 6 are schematic cross-sectional views illustrating the operation of the clutch device within an ATM according to an embodiment of the present invention. Throughout the drawings, the same reference numerals and letters are used to designate like or equivalent elements having the same function.

FIG. 4 is a schematic cross-sectional view illustrating the operational state of the clutch device before the pick-up roller shaft 34 starts rotating in the direction of arrow "a" or immediately after it finishes rotating in the direction of arrow "a", in which the actuator 20 is not operated so that its actuator rod 22 is extended from the actuator 20 in the reverse direction relative to arrow "f" direction by means of a tensile force of the second tension coil spring 36.

Referring to FIG. 4, it can be seen that the stopper 46 is received in the V-shaped groove 66 of the latch gear 32 fixedly mounted on the pick-up roller shaft 34. Like this, since the stopper 46 blocks the V-shaped groove 66, the latch gear 32 no longer rotates in the direction of arrow "a" so that the pick-up roller shaft 34 does also not rotate, which makes it impossible to extract any sheet of banknote.

Furthermore, the idle gear 42 is spaced apart from the pick-up roller gear 44 while it is engaged with the driving gear 40. Accordingly, although the driving gear 40 rotates, the rotational driving force of the driving gear 42 is not transmitted to the pick-up roller shaft 34.

Accordingly, the state in which the idle gear 42 is spaced apart from the pick-up roller gear 44 and the stopper 46 is engaged with the V-shaped groove 66 is maintained by the second tension coil spring 36 unless the actuator 20 is operated. As is well known in the prior art, when electric power is not applied to the actuator 20, an electromagnetic force is also not generated from the actuator 20 so that the actuator rod 22 can be easily moved under the influence of an external force.

Accordingly, when the application of electric power to the actuator 20 is interrupted so that its operation is stopped, the second tension coil spring 36 pulls the cover plate 30 downward in the direction of arrow "k". As a result, the cover plate 30 is maintained in a state in which it rotates about the rotating shaft 68 of the driving gear 40 in the clockwise direction.

In this standby state, when electric power is applied to the actuator 20 to activate it, the actuator rod 22 is moved in the direction of arrow "f", and simultaneously, the first tension coil spring 24 rotates the cover plate 30 in the direction of arrow "g" so that the operational state of the clutch device 70 is switched into the state shown in FIG. 6.

FIG. 5 is a schematic cross-sectional view illustrating an intermediate operation during which the operational state of the clutch device is changed from the state as shown in FIG. 4 to the state as shown in FIG. 6, in which the idle gear 42 is not engaged with the pick-up roller gear 44.

When a user externally commands the ATM to discharge banknotes, the driving gear 40 of the clutch device 70 begins to rotate and, at the same time, electric power is applied to the actuator 20. Then, the actuator rod 22 is moved in the direction of arrow "f" and, simultaneously, the first tension coil spring 24 pulls the cover plate 30 in the arrow "f" direction so that the cover plate 30 rotates in the direction of arrow "g". Of course, in this case, while the first tension coil spring 24 is moved in the direction of arrow "f", the link member 26 also is moved in the same direction simultaneously.

In the meantime, as the link member 26 is moved in the direction of arrow "f" along a certain longitudinal path, the holding projection 58 is also pulled by the first tension coil spring 24 together with the cover plate 30 in the same direction as that of the arrow "f" so that the holding projection 58 leans toward one side within the extended slot 56. At this time, the holding projection 58 is optionally moved within the extended slot 56 depending on a degree of rotation of the cover plate 30.

As shown in FIG. 5, as the actuator 20 operates, the first tension coil spring 24 allows the cover plate 30 to rotate in the direction of arrow "g", which causes the stopper 46 to be disengaged from the V-shaped groove 66, and the idle gear 42 to be moved into engagement with the pick-up roller gear 44. FIG. 5 shows a state directly before the pick-up roller 44 is engaged with the idle gear 42.

At this time, it is preferable that as the cover plate 30 rotates, the idle gear 42 and the pick-up roller gear 44 are smoothly engaged with each other, but smooth engagement is not always performed. As shown in FIG. 5, the gear teeth of the idle gear 42 and the pick-up roller gear 44 may momentarily come into contact with each other with engaging.

Accordingly, contact between the gear teeth of the idle gear 42 and the pick-up roller gear 44 means that the cover plate 30 has not been completely rotated and the holding projection 58 is relatively moved in the direction of arrow "m" within the extended slot 56.

However, as described above, although the gear teeth of the idle gear 42 and the pick-up roller gear 44 come into contact with each other, the driving gear 40 continues to rotate so that the idle gear 42 further rotates by a half-pitch to be engaged with the pick-up roller gear 44. Also, in this way, when normal engagement of the idle gear 42 with the pick-up roller gear 44 is achieved, the cover plate 30 completely rotates in the direction of arrow "g" and the holding projection 58 is also moved toward the leftmost portion within the extended slot 56 as shown in FIG. 6.

Consequently, the aim of forming the extended slot 56 at one end of the link member 26 is to provide for the possibility of the idle gear 42 not immediately engaging the pick-up roller gear 4.

When the idle gear 42 is engaged with the pick-up roller gear 44, as shown in FIG. 6, the stopper 46 is completely released from engagement with the V-shaped groove 66 and the rotational driving force of the driving gear 40 is transmitted to the pick-up roller gear 44 through the idle gear 42 to rotate the pick-up roller shaft 34 in the direction of arrow "n" so that the pick-up roller 14 (see FIG. 1) can extract banknotes from the banknote storage cassette.

In the meantime, through the above processes, once a desired number of banknotes have been extracted, the supply of electric power to the actuator 20 is interrupted so that no extra banknotes are discharged. When the supply of electric power to the actuator 20 is interrupted, force applied to the actuator rod 22 in the direction of arrow "f" shown in FIG. 5 disappears, and the cover plate 30 rotates in the direction of arrow "p" by means of the second tension coil spring 36 and, simultaneously, the idle gear 42 is disengaged from the pick-up roller gear 44.

In addition, at the moment when the disengagement of the idle gear 42 from the pick-up roller gear 44 is achieved, the stopper 46 latches onto the V-shaped groove 66 of the latch gear 32 so that the pick-up roller shaft 34 being rotated in the direction of arrow "n" is stopped instantaneously. Like this, since the stopper 46 stops the rotation of the latch gear 32, there is no extra rotation of the pick-up roller shaft 34 due to rotational inertia.

Although the stopping of the latch gear 32 does not permit the rotation of the pick-up roller, the driving gear 40 continues to rotate. Accordingly, banknotes extracted from the banknote storage cassette 12 (see FIG. 1) can be continuously fed between the driving rollers and the driven rollers along a predetermined banknote traveling path to the outside of the ATM.

In the meantime, although the rotatable support plate 28 (see FIG. 3) has not been described in FIGS. 4 through 6, it cooperates with the cover plate 30 and is moved together with the cover plate 30.

While this invention has been particularly shown and described with reference to preferred embodiments thereof, such description is for illustrative purpose only, and it will be understood by those skilled in the art that various modifications, permutations and equivalents may be made without departing from the spirit of the invention. The scope of the invention, therefore, is to be determined solely by the appended claims.

What is claimed is:

1. An automatic teller machine (ATM) comprising a frame for defining an internal space, a banknote storage cassette installed within the frame for containing a plurality of banknotes, a pick-up roller for extracting the plurality of banknotes one by one, a plurality of driving rollers for feeding the banknotes extracted from the banknote storage cassette together with a plurality of driven rollers along a predetermined banknote traveling path to discharge them, the plurality of driving rollers each being rotated by means of a rotational driving force transmitted thereto from a drive motor, and a clutch device for selectively transmitting the rotational driving force generated from the drive motor to the pick-up roller, the clutch device comprising:

a driving gear rotatably mounted to the frame for receiving the rotational driving force from the drive motor to rotate the plurality of driving rollers;

an idle gear engaged with the driving gear;

a pick-up roller gear fixedly mounted on a rotating shaft of the pick-up roller and capable of being engaged with the idle gear for rotating the pick-up roller and; and a motor control means adapted to allow the idle gear to be engaged with or disengaged from the pick-up roller.

2. The automatic teller machine (ATM) as claimed in claim 1, wherein the motor control means comprises:

an actuator laterally and fixedly mounted to the frame and having an actuator rod which operate in response to the external application of electric power thereto, and a support plate rotatably mounted to the frame such that a rotating shaft of the driving gear penetrates the support plate, the support plate supporting the idle gear and the driving gear such that they are engaged with each other and rotate about the rotating shaft of the driving gear in response to a longitudinal movement of the actuator rod so that the idle gear is engaged with or disengaged from the pick-up roller gear.

3. The automatic teller machine (ATM) as claimed in claim 2, wherein the support plate is composed of a rotatable support plate positioned between the frame and the driving gear, and a cover plate having the same shape as the rotatable support plate and rotatably mounted on the rotating shaft of the driving gear in parallel with the rotatable support plate such that the driving gear and the idle gear are engaged with each other between the rotatable support plate and the cover plate.

4. The automatic teller machine (ATM) as claimed in claim 2, wherein the actuator and the support plate are coupled to each other by means of a link member such that the link member is coupled at one end to the actuator rod and at the other end to the upper end portion of the support plate with the other end of the link member having an extended slot formed therein, and a holding projection is formed at the upper end portion of the support plate so that it fits into the slot of the link member.

5. The automatic teller machine (ATM) as claimed in claim 4, wherein the support plate is composed of a rotatable support plate positioned between the frame and the driving gear, and a cover plate having the same shape as the rotatable support plate and rotatably mounted on the rotating shaft of the driving gear in parallel with the rotatable support plate such that the driving gear and the idle gear are engaged with each other between the rotatable support plate and the cover plate.

6. The automatic teller machine (ATM) as claimed in claim 4, wherein the support plate includes a first elastic means for providing rotation momentum in a direction in which the idle gear is moved toward the pick-up roller, and a second elastic means for providing rotation momentum in a reverse direction to the direction of the first elastic means.

7. The automatic teller machine (ATM) as claimed in claim 6, wherein the support plate is composed of a rotatable support plate positioned between the frame and the driving gear, and a cover plate having the same shape as the rotatable support plate and rotatably mounted on the rotating shaft of the driving gear in parallel with the rotatable support plate such that the driving gear and the idle gear are engaged with each other between the rotatable support plate and the cover plate.

8. The automatic teller machine (ATM) as claimed in claim 6, wherein the first elastic means is a first tension coil spring disposed in parallel with the link member such that the first tension coil spring is coupled at one end to the actuator rod and at the other end to the support plate so as to provide a tensile force, and the second elastic means is a second tension coil spring fixedly coupled at one end to the lower end of the frame and at the other end to the frame so as to provide a tensile force.

9. The automatic teller machine (ATM) as claimed in claim 8, wherein the support plate is composed of a rotatable support plate positioned between the frame and the driving gear, and a cover plate having the same shape as the rotatable support plate and rotatably mounted on the rotating shaft of the driving gear in parallel with the rotatable support plate such that the driving gear and the idle gear are engaged with each other between the rotatable support plate and the cover plate.

10. The automatic teller machine (ATM) as claimed in claim 2, wherein the support plate comprises a stopping means for stopping the pick-up roller gear at the moment when the idle gear is moved away from the pick-up roller gear in response to the rotation of the support plate.

11. The automatic teller machine (ATM) as claimed in claim 10, wherein the support plate is composed of a rotatable support plate positioned between the frame and the driving gear, and a cover plate having the same shape as the rotatable support plate and rotatably mounted on the rotating shaft of the driving gear in parallel with the rotatable support plate such that the driving gear and the idle gear are engaged with each other between the rotatable support plate and the cover plate.

12. The automatic teller machine (ATM) as claimed in claim 10, wherein the stopping means comprises:

a latch gear fixedly mounted on the rotating shaft of the pick-up roller and having a plurality of V-shaped grooves; and a stopper fastened to the support plate, the stopper being moved into engagement with one of the plurality of V-shaped grooves to stop the pick-up roller gear at the moment when the idle gear is moved away from the pick-up roller gear in response to the rotation of the support plate.

13. The automatic teller machine (ATM) as claimed in claim 12, wherein the support plate is composed of a rotatable support plate positioned between the frame and the driving gear, and a cover plate having the same shape as the rotatable support plate and rotatably mounted on the rotating shaft of the driving gear in parallel with the rotatable support plate such that the driving gear and the idle gear are engaged with each other between the rotatable support plate and the cover plate.

14. A dispensing mechanism, comprising:

storage containing a plurality of flat items to be dispensed;

a pick-up roller for extracting said items one by one; and a plurality of driving rollers driven by a drive motor and positioned to feed ones of said items which have been extracted by said pick-up roller along a predetermined traveling path to discharge them;

wherein said pick-up roller is controllably powered by said motor, without any intervening friction clutch, through a linkage which includes a brake, and a gear linkage which is operable to be engaged or disengaged.

15. A method for dispensing currency, comprising the actions of:

a) when dispensing is desired, engaging gears to mechanically transmit power from a motor to a pick-up roller which extracts items one by one from a storage location; and b) at the end of said step a), disengaging said gears, and braking said pick-up roller, while still operating said motor to drive a plurality of driving rollers to feed any ones of said items which have been extracted by said pick-up roller along a predetermined traveling path to discharge them;

wherein no friction clutch is used for said engaging and disengaging actions.

16. A method for selectively transmitting the rotational driving force to the pick up roller in a dispensing mechanism, comprising the actions of:

positioning a plurality of driving rollers rotated by a driving gear;

engaging an idle gear with said driving gear;

positioning a pick-up roller gear on the rotating shaft of a pick-up roller, said pick-up roller gear capable of being engaged with the idle gear for rotating the pick-up roller; and applying an external application of electric power to cause motion of an actuator rod, wherein said idle gear becomes engaged with or disengaged from the pick-up roller gear, resulting in the engagement and disengagement, respectively, of the pick-up roller, in response to the longitudinal movement of said actuator rod.

* * * * *